US009291980B2

(12) United States Patent
Katsura et al.

(10) Patent No.: US 9,291,980 B2
(45) Date of Patent: Mar. 22, 2016

(54) IMAGE FORMING APPARATUS THAT DETERMINES USER-INDUCED PAPER JAM

(75) Inventors: Norichika Katsura, Osaka (JP); Kohji Aoki, Osaka (JP); Masaharu Kimura, Osaka (JP); Yasuaki Fukada, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/347,161

(22) PCT Filed: Aug. 24, 2012

(86) PCT No.: PCT/JP2012/071416

§ 371 (c)(1),
(2), (4) Date: Mar. 25, 2014

(87) PCT Pub. No.: WO2013/047040

PCT Pub. Date: Apr. 4, 2013

(65) Prior Publication Data

US 2014/0219669 A1 Aug. 7, 2014

(30) Foreign Application Priority Data

Sep. 26, 2011 (JP) ..... 2011-208910

(51) Int. Cl.

| | |
|---|---|
| ***G03G 15/00*** | (2006.01) |
| ***B65H 43/06*** | (2006.01) |
| ***B41J 11/00*** | (2006.01) |
| ***B41J 13/10*** | (2006.01) |
| ***B65H 31/02*** | (2006.01) |

(52) U.S. Cl.

CPC ..... *G03G 15/70* (2013.01); *B41J 11/006* (2013.01); *B41J 13/106* (2013.01); *B65H 31/02* (2013.01); *B65H 43/06* (2013.01); *G03G 15/6552* (2013.01); *B65H 2511/51* (2013.01); *B65H 2511/528* (2013.01); *B65H 2511/529* (2013.01); *B65H 2553/612* (2013.01); *G03G 2215/00548* (2013.01); *G03G 2215/00911* (2013.01)

(58) Field of Classification Search

CPC ..... G03G 15/70; G03G 2215/00548; G03G 2215/00911; B65H 2511/528; B65H 2511/529; B65H 2601/255; B65H 2601/271

See application file for complete search history.

(56) References Cited

U.S. PATENT DOCUMENTS

2008/0095545 A1* 4/2008 Nishitani et al. ..... 399/18
2009/0295083 A1* 12/2009 Kitan ..... 271/306

FOREIGN PATENT DOCUMENTS

JP 02251470 A * 10/1990 ..... B41J 11/42
JP 2003-192225 7/2003
JP 2004-309943 11/2004

OTHER PUBLICATIONS

International Search Report for PCT/JP2012/071416, mailed Sep. 18, 2012.

*Primary Examiner* — Justin Olamit
(74) *Attorney, Agent, or Firm* — Nixon & Vanderhye P.C.

(57) ABSTRACT

An image forming apparatus (100) includes a discharge section (210), a paper receiving tray (93), a first detecting section (211), a lever (220), a second detecting section (230) and a decision section (240). The first detecting section (211) is disposed in the discharge section (210), and detects a paper jam. The second detecting section (230) detects a swinging state of the lever (220) from a first position at which the lever (220) is not in the process of receiving an action of the paper sheet to a second position. The decision section (240) judges an occurrence factor in a paper jam to be a user-induced factor when the second detecting section (230) detects a state in which the lever is at the first position in a state where the first detecting section (211) detects the paper jam. Also, the decision section (240) judges the occurrence factor in the paper jam to be an image forming apparatus-induced factor when the second detecting section (230) detects a state in which the lever is swung over the first position in the state where the first detecting section detects the paper jam.

7 Claims, 19 Drawing Sheets

IMAGE FORMING APPARATUS THAT DETERMINES USER-INDUCED PAPER JAM

This application is the U.S. national phase of International Application No. PCT/JP2012/071416, filed 24 Aug. 2012, which designated the U.S. and claims priority to Japan Application No. 2011-208910, filed 26 Sep. 2011, the entire contents of each of which are hereby incorporated by reference.

TECHNICAL FIELD

The present invention relates to an image forming apparatus capable of making a decision on an occurrence factor in a paper jam.

BACKGROUND ART

In conventional image forming apparatus, only a paper discharge detecting sensor has been used for a decision on a paper jam. That is to say, it has been a known practice that unless a paper discharge detecting sensor becomes a sensing state within a predetermined time the conveyance of a paper sheet is stopped as a result of a judgment of a non-arrival jam, and that unless the paper discharge detecting sensor becomes a non-sensing state within a predetermined time the conveyance of the paper sheet is stopped as a result of a judgment of a stagnating jam.

Also, it has been a known practice that with a fullness detecting sensor provided for detecting a fullness of the paper sheets on a paper receiving tray apart from the paper discharge detecting sensor a control section makes a judgment of fullness if the fullness detecting sensor remains in the sensing state more than a predetermined time, and that the conveyance of the paper sheet is stopped thereby.

However, providing the paper discharge detecting sensor and the fullness detecting sensor provided together requires improved accuracy on respective components related, which has resulted in cost increase.

Then, an image forming apparatus has been disclosed in which detection of whether or not the paper sheet is discharged onto the paper receiving tray and detection of whether or not the paper sheets discharged onto the paper receiving tray are full are carried out by a single sensing device (for example, refer to Patent Literature 1).

CITATION LIST

Patent Literature

Patent Literature 1: Japanese Patent Unexamined Publication No. 2003-192225 bulletin

SUMMARY OF INVENTION

Technical Problem

However, with the image forming apparatus disclosed in the Patent Literature 1, there have been occurrences of a case in which a user, when removing the user's own paper sheets from a large quantity of paper sheets that have been discharged onto the paper receiving tray by once taking all the large quantity of paper sheets out of the paper receiving tray and then by picking up the user's own paper sheets from the large quantity of paper sheets, returns the rest of the paper sheets onto the paper receiving tray inadvertently placing them on a detection lever of the sensing device. When next paper sheet is discharged in this state, the detection lever cannot swing even if a front edge of the paper sheet bumps against the detection lever; therefore, the above case has inappropriately been determined to be a paper jam.

Although a jam history remains even when the paper sheets on the detection shifter lever are removed after the occurrence, it has been difficult for a field service personnel to make a decision as to whether the jam occurred due to a user-induced factor or an image forming apparatus-induced factor; so that there has been a problem that an appropriate maintenance task can hardly be performed.

Thus, in view of the above-mentioned problem, the present invention is directed to providing an image forming apparatus capable of making a decision on an occurrence factor in a paper jam.

Solution to Problem

An image forming apparatus of the present invention includes a discharge section, a paper receiving tray, a first detecting section, a lever, a second detecting section and a decision section.

The discharge section discharges a paper sheet that has undergone an image forming. The paper receiving tray receives thereon the paper sheets discharged from the discharge section. The first detecting section is disposed in the discharge section, and detects a paper jam. The lever protrudes toward the paper receiving tray's side, and is caused to swing by being pushed by a front edge of the paper sheet. The second detecting section detects a swinging state of the lever from a first position at which the lever is not in the process of receiving an action of the paper sheet to a second position.

When the second detecting section detects a state in which the lever is at the first position in a state where the first detecting section detects a paper jam, the decision section judges an occurrence factor in the paper jam to be a user-induced factor. Also, when the second detecting section detects a state in which the lever is swung over the first position in the state where the first detecting section detects the paper jam, the decision section judges the occurrence factor in the paper jam to be an image forming apparatus-induced factor.

With the configuration, because it is made possible to make a decision as to whether an occurrence factor in a paper jam that has occurred in the image forming apparatus is the user-induced factor or the image forming apparatus-induced factor, the field service personnel, with the decision result stored and/or displayed, can perform the maintenance task on the image forming apparatus correspondingly to the occurrence factor in the paper jam.

Advantageous Effects of Invention

An image forming apparatus of the present invention is capable of making a decision on an occurrence factor in a paper jam.

DESCRIPTION OF EMBODIMENTS

Figure 1:
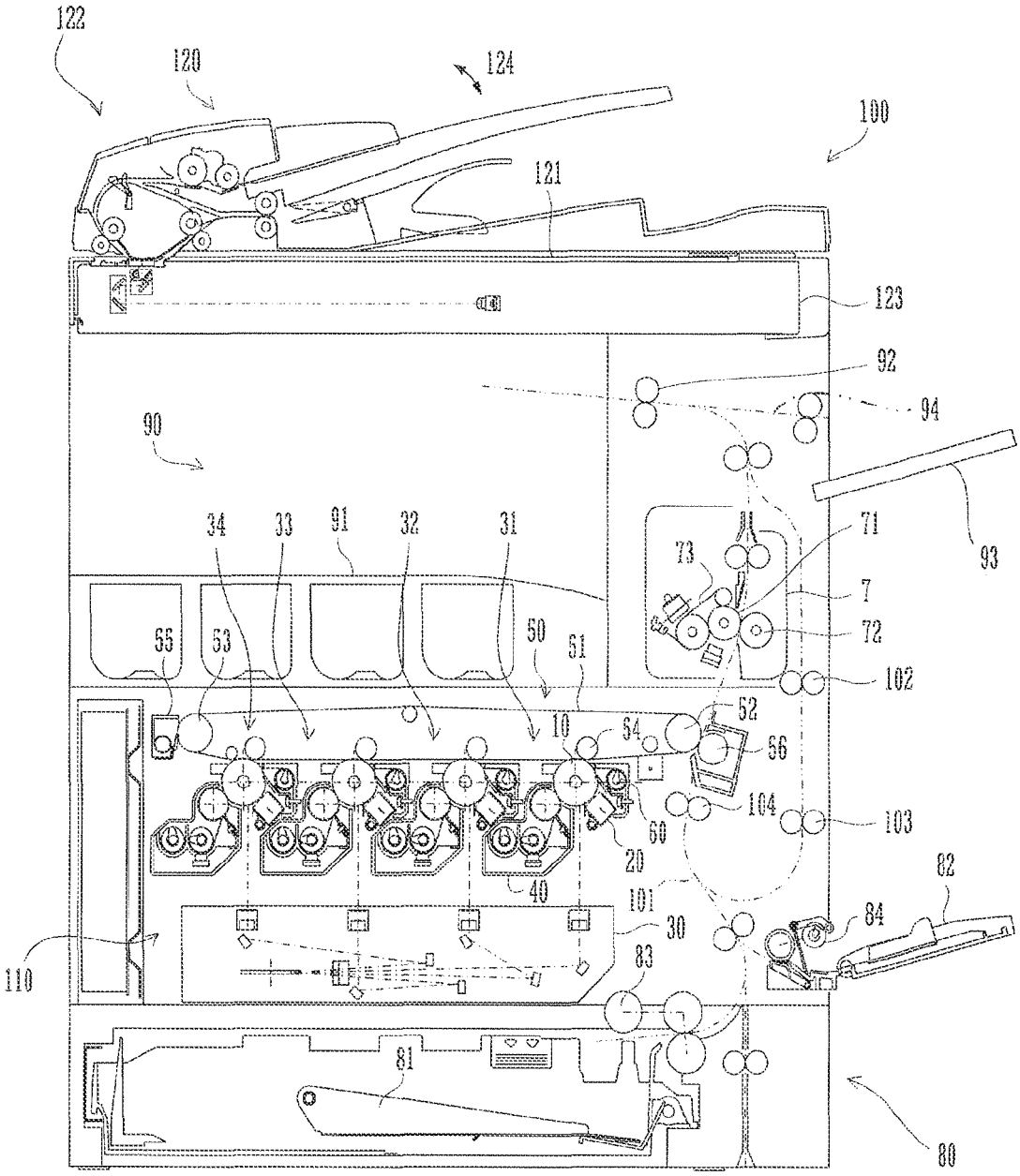
FIG. 1 is a drawing showing a configuration of an image forming apparatus according to a first embodiment of the present invention.

Below, image forming apparatus according to embodiments of the present invention are explained in detail, referring to the drawings.

Firstly, a first embodiment of the present invention is explained.

FIG. 1 is a drawing showing a configuration of an image forming apparatus 100 according to the first embodiment of the present invention.

The image forming apparatus 100 forms a multicolored or monochromatic image corresponding to image data transmitted from outside onto a predetermined sheet (recording paper sheet). The image forming apparatus 100 includes a document processing device 120, a paper feeding section 80, an image forming section 110, and a paper discharge section 90.

The document processing device 120 includes a document load table 121, a document feeder 122, and a document reading section 123. The document load table 121 is configured in such a manner as to allow a document to be placed thereon. The document feeder 122 conveys, piece by piece, documents that are loaded on the document load table 121. Also, the document feeder 122 is configured in such a manner as to be capable of being swung in directions of arrows 124, which makes it possible for the document to be placed on the document load table 121 by opening the upside of the document load table 121. The document reading section 123 reads the document that is being conveyed by the document feeder 122 or is placed on the document load table 121.

The paper feeding section 80 includes a paper feed cassette 81, a manual paper feed cassette 82, a pickup roller 83 and a pickup roller 84. The paper feed cassette 81 is a tray to store the sheets of a standard size. The manual paper feed cassette 82 is a tray on which a sheet of a non-standard size can be placed. The pickup roller 83, being installed in the neighborhood of an edge portion of the paper feed cassette 81, supplies the sheet by picking it up piece by piece from the paper feed cassette 81 to a paper sheet conveying path 101. Similarly, the pickup roller 84, being installed in the neighborhood of an edge portion of the manual paper feed cassette 82, supplies the sheet by picking it up piece by piece from the manual paper feed cassette 82 to the paper conveying path 101.

The image forming section 110 includes image forming stations 31, 32, 33, 34, an exposure unit 30, an intermediate transfer belt unit 50 and a fuser unit 70. The image forming stations 31, 32, 33, 34, are each provided with a photoreceptor drum 10, an electrostatic charger 20, an developing device 40 and a cleaner unit 60, corresponding to each color image to be formed using each color of black (K), cyan (C), magenta (M) and yellow (Y). In the embodiment, the image forming station 31 is explained.

The photoreceptor drum 10 rotates at the time of an image forming, and is an article for bearing a developer image. Around the photoreceptor drum 10, the electrostatic charger 20, the exposure unit 30, the developing device 40, the intermediate transfer belt unit 50, and the cleaner unit 60 are disposed in this order from the upstream side in a rotating direction. The fuser unit 70 is located most downstream in the paper sheet conveying path 101 in the image forming section 110.

The electrostatic charger 20 is a means for charging a surface of the photoreceptor drum 10 uniformly at a predetermined electric potential. The exposure unit 30 has a function of forming an electrostatic latent image that corresponds to image data inputted on the surface of the photoreceptor drum 10 by exposing the photoreceptor drum 10 of which surface is charged with electricity according to the inputted image data. The developing device 40 is an article that renders the electrostatic latent image formed on the photoreceptor drum 10 a manifest image with a toner.

The intermediate transfer belt unit 50 includes an intermediate transfer belt 51, an intermediate transfer belt drive roller 52, an intermediate transfer belt idle roller 53, an intermediate transfer roller 54, and an intermediate transfer belt cleaning unit 55.

The intermediate transfer belt 51 is passed over the intermediate transfer belt drive roller 52, the intermediate transfer belt idle roller 53 and the intermediate transfer roller 54, being tensioned therewith and rotatively driven thereby. Also, the intermediate transfer roller 54 provides a transfer bias for transferring the toner image on the photoreceptor drum 10 onto the intermediate transfer belt 51.

The intermediate transfer belt 51 is installed in such a manner as to be in contact with the photoreceptor drum 10. Then, by transferring the toner image formed on the photoreceptor drum 10 onto the intermediate transfer belt 51, the toner image is formed on the intermediate transfer belt 51. The intermediate transfer belt 51 is formed in an endless shape.

The transfer of the toner image from the photoreceptor drum 10 onto the intermediate transfer belt 51 is performed by the intermediate transfer roller 54 that is in contact with a backside of the intermediate transfer belt 51. To the intermediate transfer roller 54, the transfer bias (a high voltage of a polarity (+) reverse to an electrostatic charge polarity (−) of the toner) is applied to transfer the toner image.

The electrostatic latent image that has been rendered the manifest image on the photoreceptor drum 10 as described above is superimposed on the intermediate transfer belt 51. The image information thus superimposed is transferred, with the intermediate transfer belt 51 rotating, onto a paper sheet by a transfer roller 56 disposed at a position where a paper sheet comes into contact with the intermediate transfer belt 51.

Further, a setting is made in such a manner that the toner sticking onto the intermediate transfer belt 51 through the contact with the photoreceptor drum 10 as mentioned above, or the toner remaining on the intermediate transfer belt 51 without being transferred onto the paper sheet by the transfer roller 56 is removed and collected by the intermediate transfer belt cleaning unit 55. The cleaner unit 60 removes and collects the toner remaining on the surface of the photoreceptor drum 10 after the developing and the image transfer.

The fuser unit 70 includes a heating roller 71 and a pressing roller 72, and the heating roller 71 and the pressing roller 72 are configured in such a manner as to rotate sandwiching a sheet in between. Also, an external heating belt 73 is provided to heat the heating roller 71 from outside.

The paper discharge section 90 includes a paper receiving tray 91 and a paper discharge roller 92. The paper sheet that has passed the fuser unit 70 passes through the paper discharge roller 92, and is discharged onto the paper receiving tray 91. The paper receiving tray 91 is a tray for collecting the sheets that have undergone printing.

Additionally, the paper discharge section 90 further includes a paper receiving tray 93. A paper sheet having passed through the fuser unit 70 is once held by the paper discharge roller 92. After that, the paper discharge roller 92 rotates in reverse direction, and then the paper sheet, passing through the paper sheet conveying path 94, is discharged onto the paper receiving tray 93.

Further, at the time of a double-sided printing demand, when a rear edge of the sheet that has undergone a single-sided printing and has passed through the fuser unit 70 is held by the paper discharge roller 92 as described above, the sheet is led to conveyance rollers 102, 103 by the paper discharge roller 92 rotating in the reverse direction. Thereafter, after passing through a paper stop roller 104 and undergoing a printing on an opposite face, the sheet is discharged onto the paper receiving tray 91.

Figure 2:
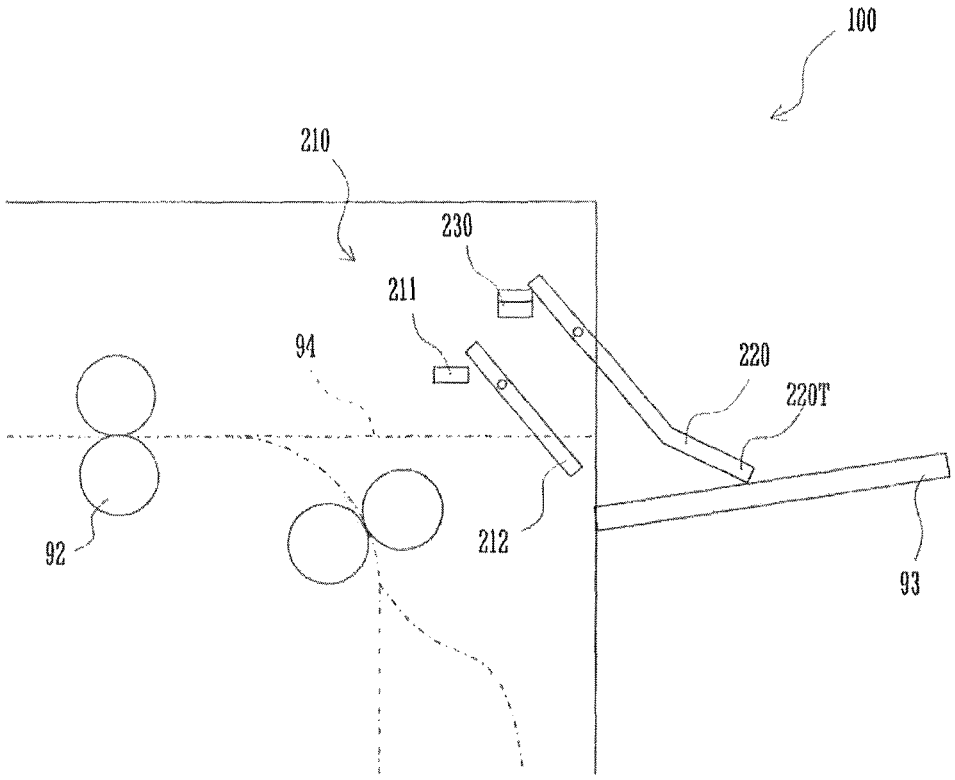
FIG. 2 is a drawing showing an essential part of the image forming apparatus according to the first embodiment of the present invention.
Figure 3:
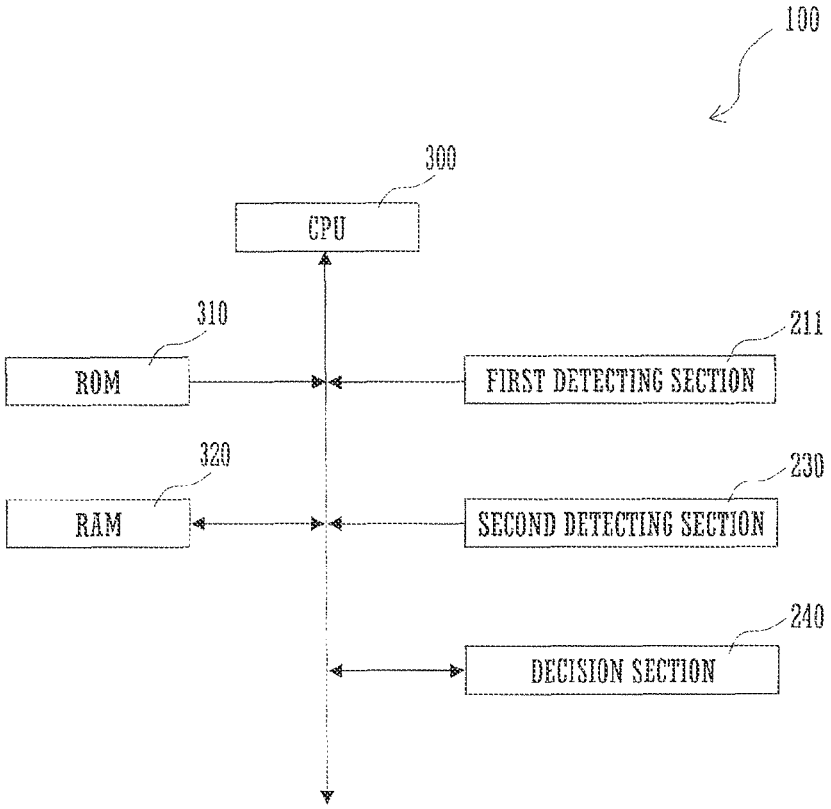
FIG. 3 is a block diagram showing the essential part of the image forming apparatus according to the first embodiment of the present invention.

FIG. 2 is a drawing showing an essential part of the image forming apparatus according to the first embodiment of the present invention. FIG. 3 is a block diagram showing the essential part of the image forming apparatus according to the first embodiment of the present invention.

The image forming apparatus 100 includes a discharge section 210, the paper receiving tray 93, a first lever 212, a first detecting section 211 that senses when the first lever 212 swings, a second lever 220 with a tip portion 220T, a second detecting section 230 that senses when the second lever 220 swings, a decision section 240, a CPU 300, a ROM 310 and a RAM 320.

The discharge section 210 discharges a paper sheet having undergone an image forming. The paper receiving tray 93 receives thereon the paper sheets discharged from the discharge section 210. The first detecting section 211 is disposed in the discharge section 210, and detects a paper jam. The second lever 220 protrudes toward the paper receiving tray 93's side, and is caused to swing by being pushed by a front edge of the paper sheet.

The second detecting section 230 detects a swinging state of the second lever 220 from a first position at which the second lever 220 is not in the process of receiving an action of the paper sheet to a second position. Here, the above phrase stating that the second lever 220 is not in the process of receiving an action of the paper sheet means, for example, that the second lever 220 is not in a state of being pushed and swung by the front edge of a paper sheet that is being discharged from the discharge section, as illustrated in FIG. 2.

Figure 18:
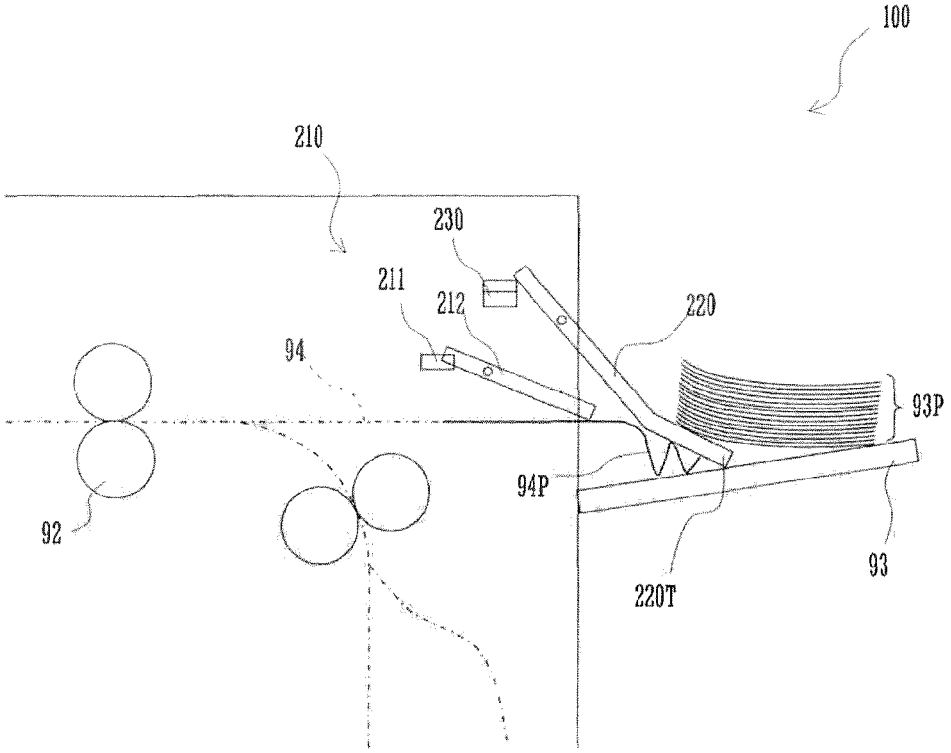
FIG. 18 is a diagram showing an essential part of an image forming apparatus according to some embodiments of the present invention for an explanation of a paper jam occurred by a user-induced factor.

When the second detecting section 230 detects a state in which the second lever 220 is at the first position at the same time that the first detecting section 211 detects a paper jam, as shown in FIG. 18, the decision section 240 judges an occurrence factor in the paper jam to be a user-induced factor, because a user has improperly left a stack of paper sheets on top of the second lever 220

Figure 19:
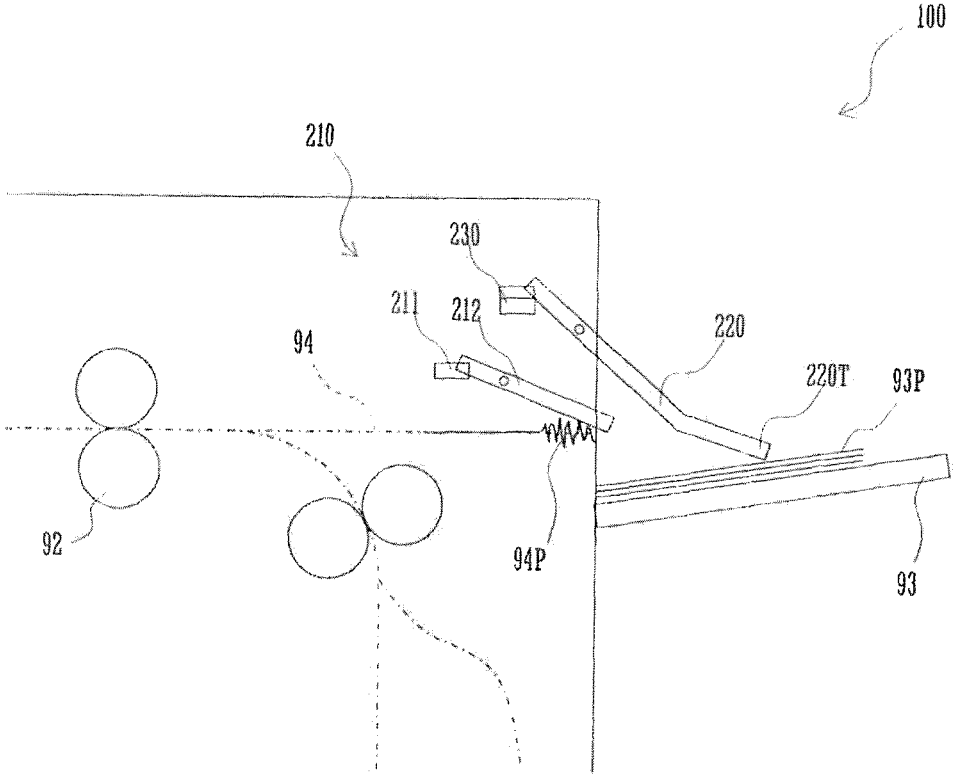
FIG. 19 is a diagram showing an essential part of an image forming apparatus according to some embodiments of the present invention for an explanation of a paper jam occurred by an image forming apparatus-induced factor.

When the second detecting section 230 detects a state in which the second lever 220 is swung away from the first position at the same time that the first detecting section 211 detects the paper jam, as shown in FIG. 19, the decision section 240 judges the occurrence factor in the paper jam to be an image forming apparatus-induced factor.

The CPU 300 reads out and performs programs stored in the ROM 310, and generally controls the respective sections of the image forming apparatus 100. The RAM 320 is utilized as a working area for the CPU 300.

Figure 4:
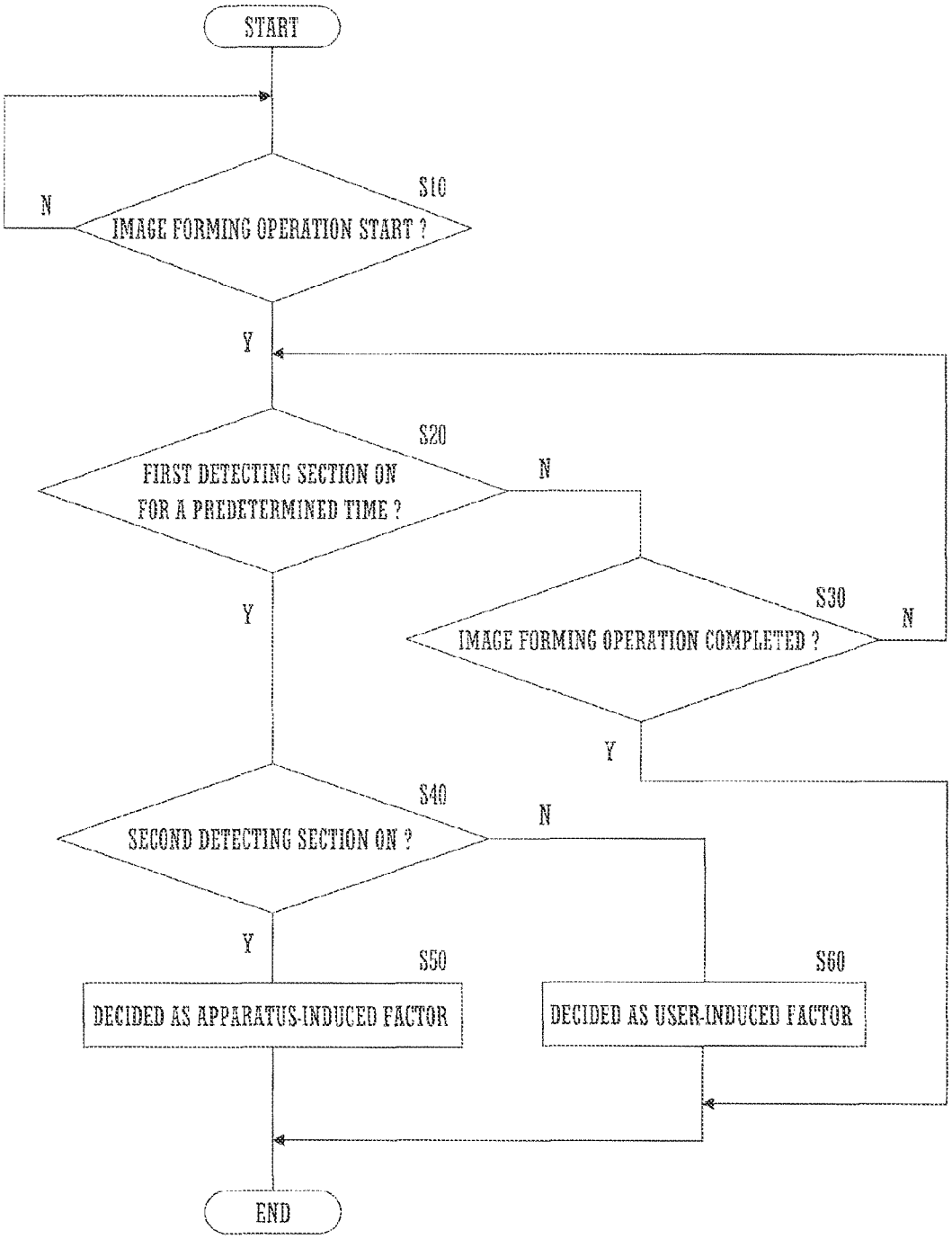
FIG. 4 is a flow chart showing control details of the image forming apparatus according to the first embodiment of the present invention.

FIG. 4 is a flow chart showing control details of the image forming apparatus according to the first embodiment of the present invention.

The CPU 300 waits for an image forming operation to start (N at S10). The CPU 300, upon determining that the image forming operation has started (Y at S10), determines whether or not the first detecting section 211 maintains a sensing state for a predetermined time (S20). The CPU 300, upon determining that the first detecting section 211 has not maintained the sensing state for the predetermined time (N at S20), determines whether or not the image forming operation is completed (S30). The CPU 300, upon determining that the image forming operation has been completed (Y at S30), finishes the control according to the embodiment. On the other hand, if the CPU 300 determines that the image forming operation is not completed (N at S30), it returns to S20 in the control.

The CPU 300, upon determining that the first detecting section 211 has maintained the sensing state for the predetermined time (Y at S20), determines whether or not the second detecting section 230 detects a state in which the second lever 220 is swung over the first position (S40). Here, in the expression "Second detecting section ON ?" at S40 in FIG. 4, the ON shows that the state is detected in which the second lever 220 is swung away from the first position; and conversely, an OFF shows that a state is detected in which the second lever 220 is at the first position.

If the CPU 300 determines that the second detecting section 230 detects the state in which the second lever 220 is swung away from the first position (Y at S40), the decision section 240 judges the occurrence factor in the paper jam to be the image forming apparatus-induced factor (S50), and finishes the control according to the embodiment. And if the CPU 300 determines that the second detecting section 230 detects the state in which the second lever 220 is at the first position (N at S40), the decision section 240 judges the occurrence factor in the paper jam to be the user-induced factor (S60), and finishes the control according to the embodiment.

With the configuration, because it is made possible to make a decision as to whether an occurrence factor in a paper jam that has occurred in the image forming apparatus 100 is a user-induced factor or an image forming apparatus-induced factor, a field service personnel, with the decision result stored and/or displayed, can perform a maintenance task on the image forming apparatus 100 correspondingly to the occurrence factor in the paper jam.

Subsequently, a second embodiment of the present invention is explained. Here, as to respective embodiments from this embodiment onward, explanations of parts that overlap with those of the first embodiment are omitted.

Figure 5:
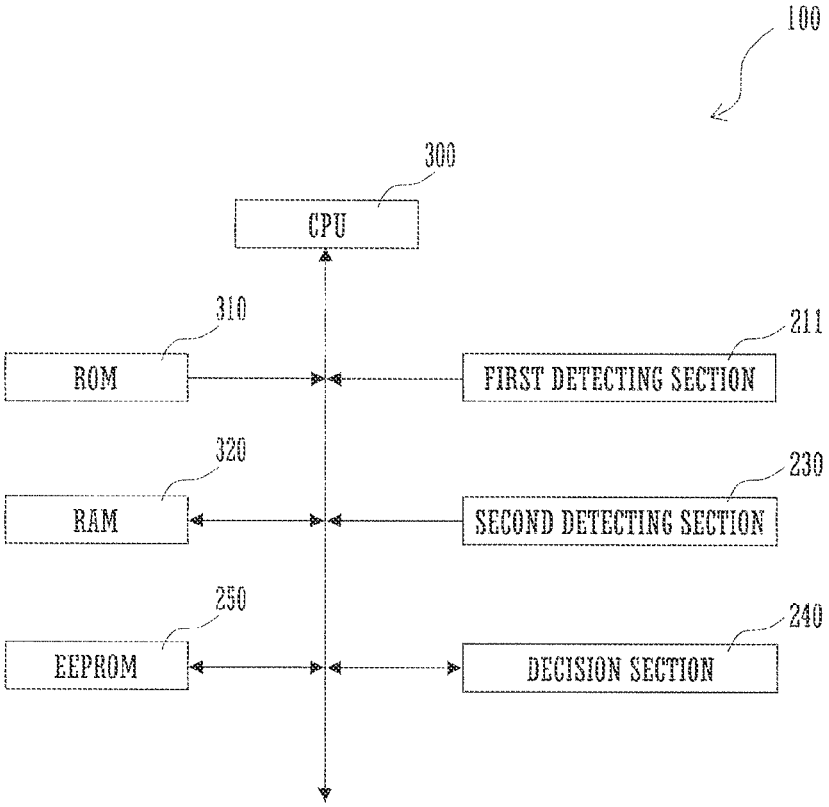
FIG. 5 is a block diagram showing an essential part of an image forming apparatus according to a second embodiment of the present invention.

FIG. 5 is a block diagram showing an essential part of an image forming apparatus according to the second embodiment of the present invention.

The image forming apparatus 100 according to the second embodiment further includes an EEPROM 250 in relation to the image forming apparatus 100 according to the first embodiment. The EEPROM 250 corresponds to a memory section of the present invention. The EEPROM 250 stores a result of the decision made by the decision section 240.

Figure 6:
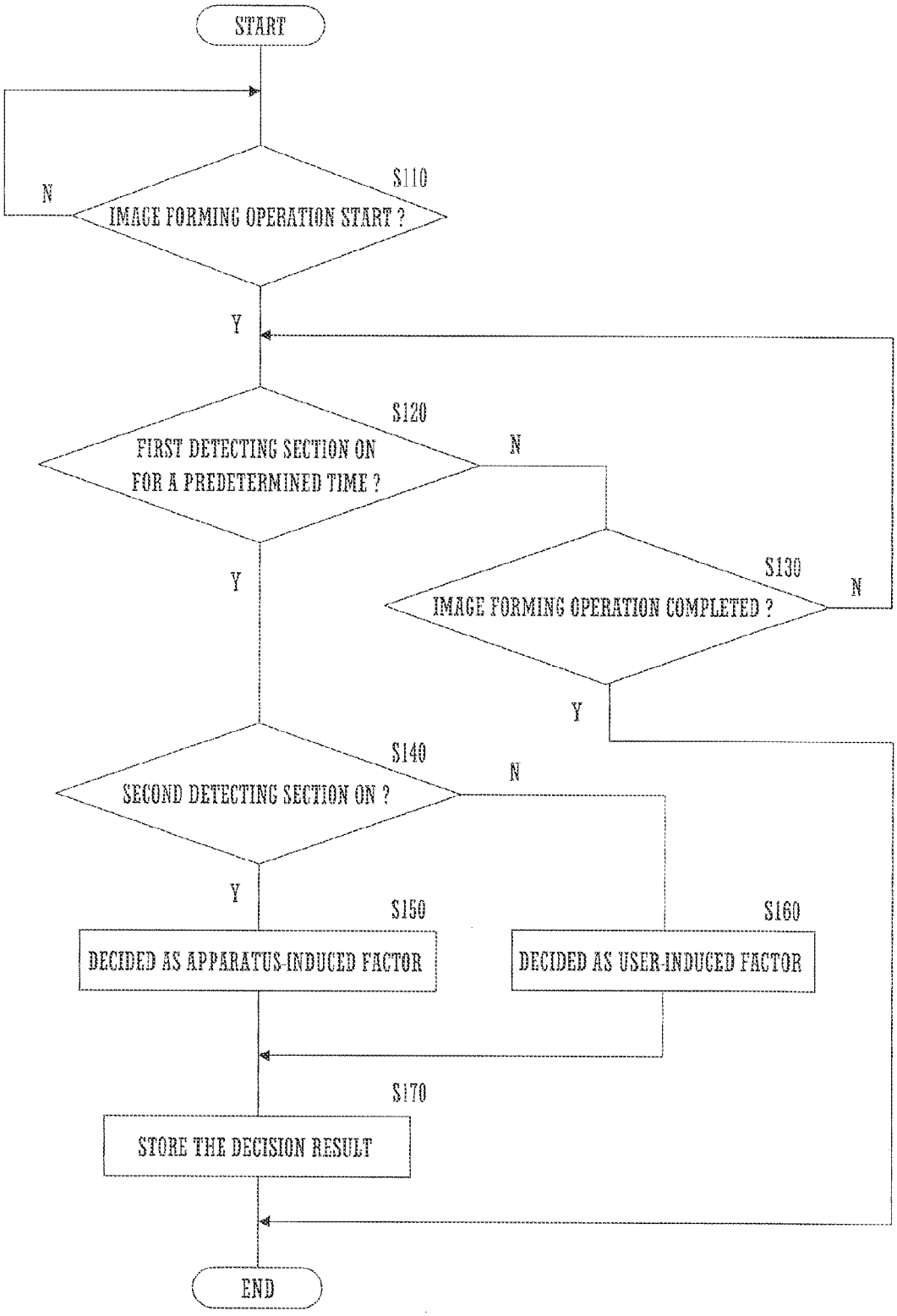
FIG. 6 is a flow chart showing control details of the image forming apparatus according to the second embodiment of the present invention.

FIG. 6 is a flow chart showing control details of the image forming apparatus according to the second embodiment of the present invention.

S110 through S160 show the same control details as S10 through S60. After a decision is made on the occurrence factor in the paper jam by the decision section 240 (S150, S160), the CPU 300 causes the EEPROM 250 to store the decision result (S170), and finishes the control according to this embodiment.

With this configuration, because it is made possible to store the result of the decision made by the decision section 240, the field service personnel, by referring to the contents stored, can perform the maintenance task on the image forming apparatus 100 correspondingly to the occurrence factor in the paper jam.

Next, a third embodiment of the present invention is explained.

Figure 7:
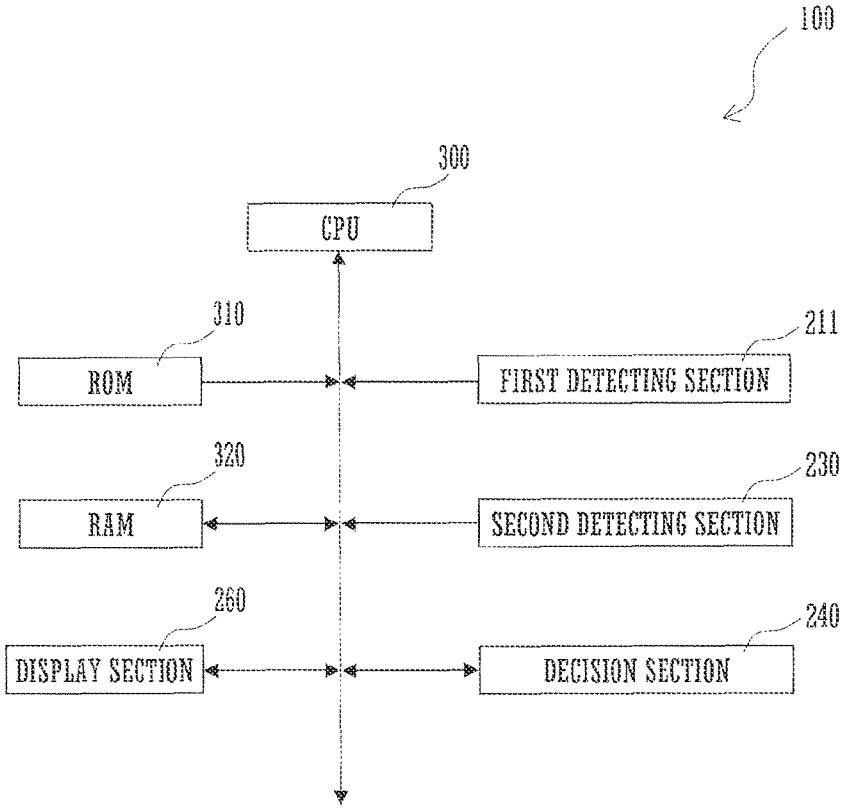
FIG. 7 is a block diagram showing an essential part of an image forming apparatus according to a third embodiment of the present invention.

FIG. 7 is a block diagram showing an essential part of an image forming apparatus according to the third embodiment of the present invention.

The image forming apparatus 100 according to the third embodiment further includes a display section 260 in relation to the image forming apparatus 100 according to the first embodiment. The display section 260 corresponds to a first display section of the present invention. The display section 260 displays the result of the decision made by the decision section 240.

Figure 8:
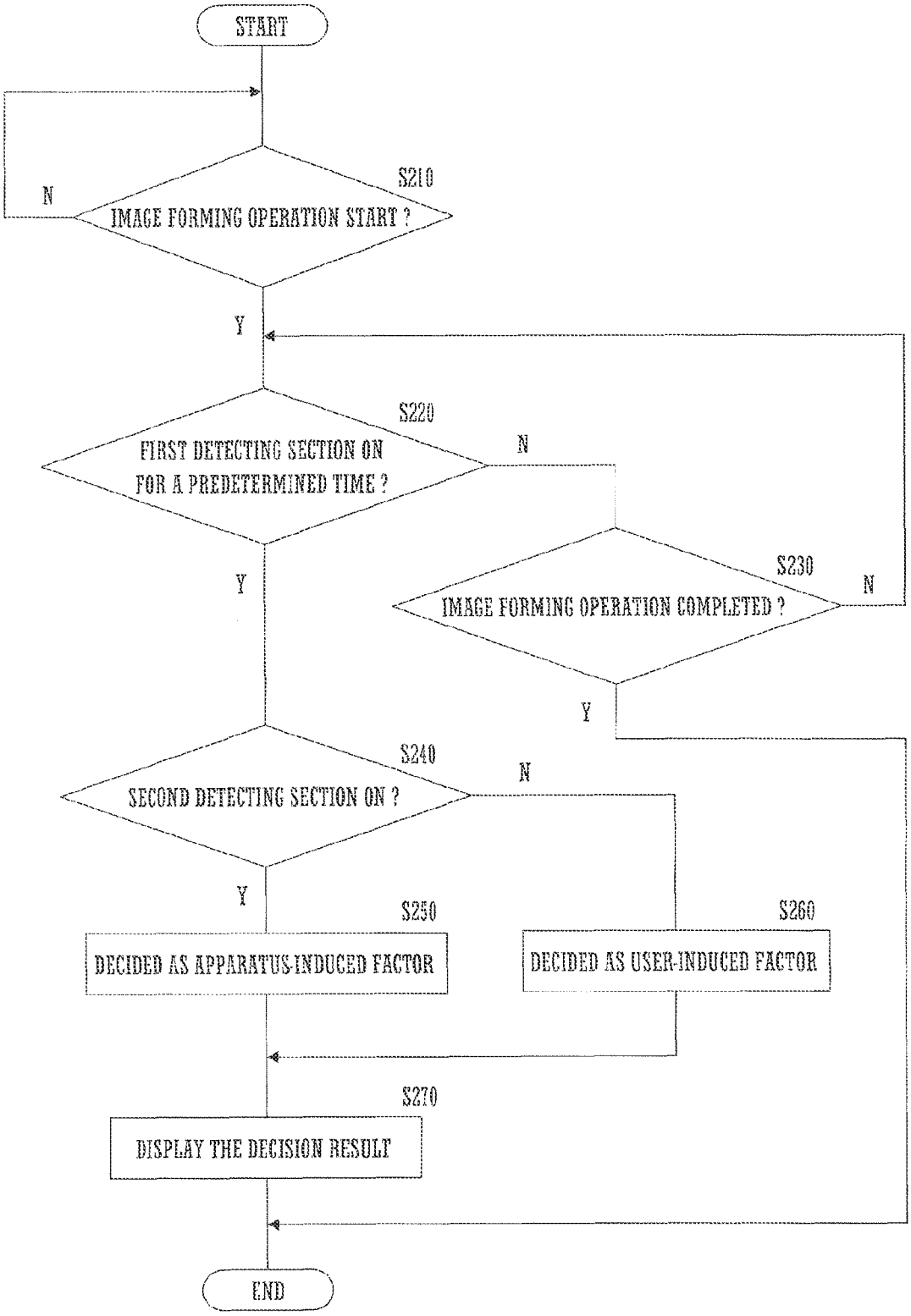
FIG. 8 is a flow chart showing control details of the image forming apparatus according to the third embodiment of the present invention.

FIG. 8 is a flow chart showing control details of the image forming apparatus according to the third embodiment of the present invention.

Figure 9:
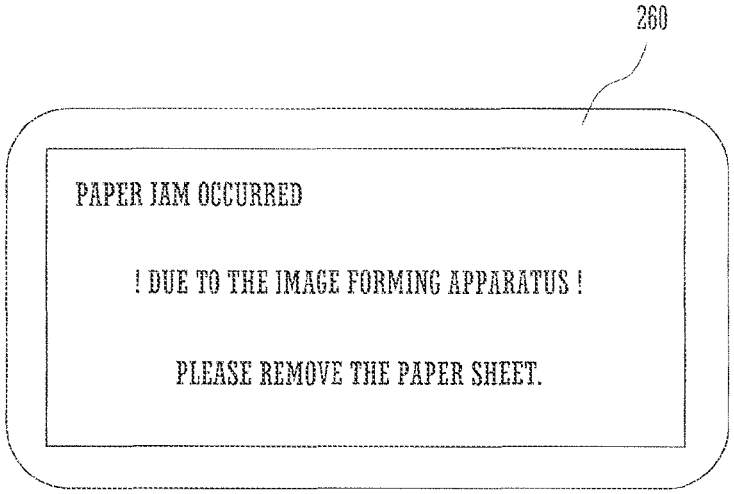
FIG. 9 is a diagram showing contents displayed on a first display section.

S210 through S260 show the same control details as S10 through S60. After a decision is made on the occurrence factor in the paper jam by the decision section 240 (S250, S260), the CPU 300 causes the display section 260 to display the decision result (S270), and finishes the control according to this embodiment. Contents displayed on the display section 260 are shown in FIG. 9.

With this configuration, because it is made possible to display the result of the decision made by the decision section 240, either a user or a service personnel, by referring to the contents displayed, can deal with the occurrence factor in the paper jam.

Subsequently, a fourth embodiment of the present invention is explained.

Figure 10:
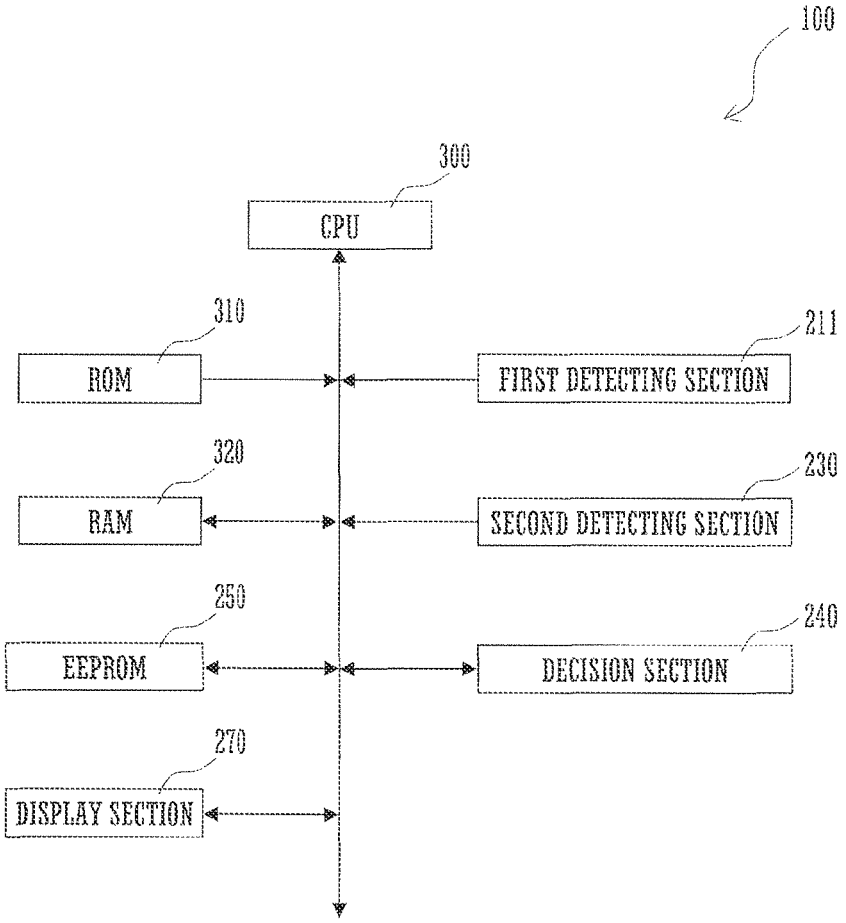
FIG. 10 is a block diagram showing an essential part of an image forming apparatus according to a fourth embodiment of the present invention.

FIG. 10 is a block diagram showing an essential part of an image forming apparatus according to the fourth embodiment of the present invention.

The image forming apparatus 100 according to the fourth embodiment further includes an EEPROM 250 and a display section 270 in relation to the image forming apparatus 100 according to the first embodiment. The display section 270 corresponds to a second display section of the present invention. The display section 270 displays the occurrence factor (s) in the paper jam(s) stored by the EEPROM 250 as a history.

Figure 11:
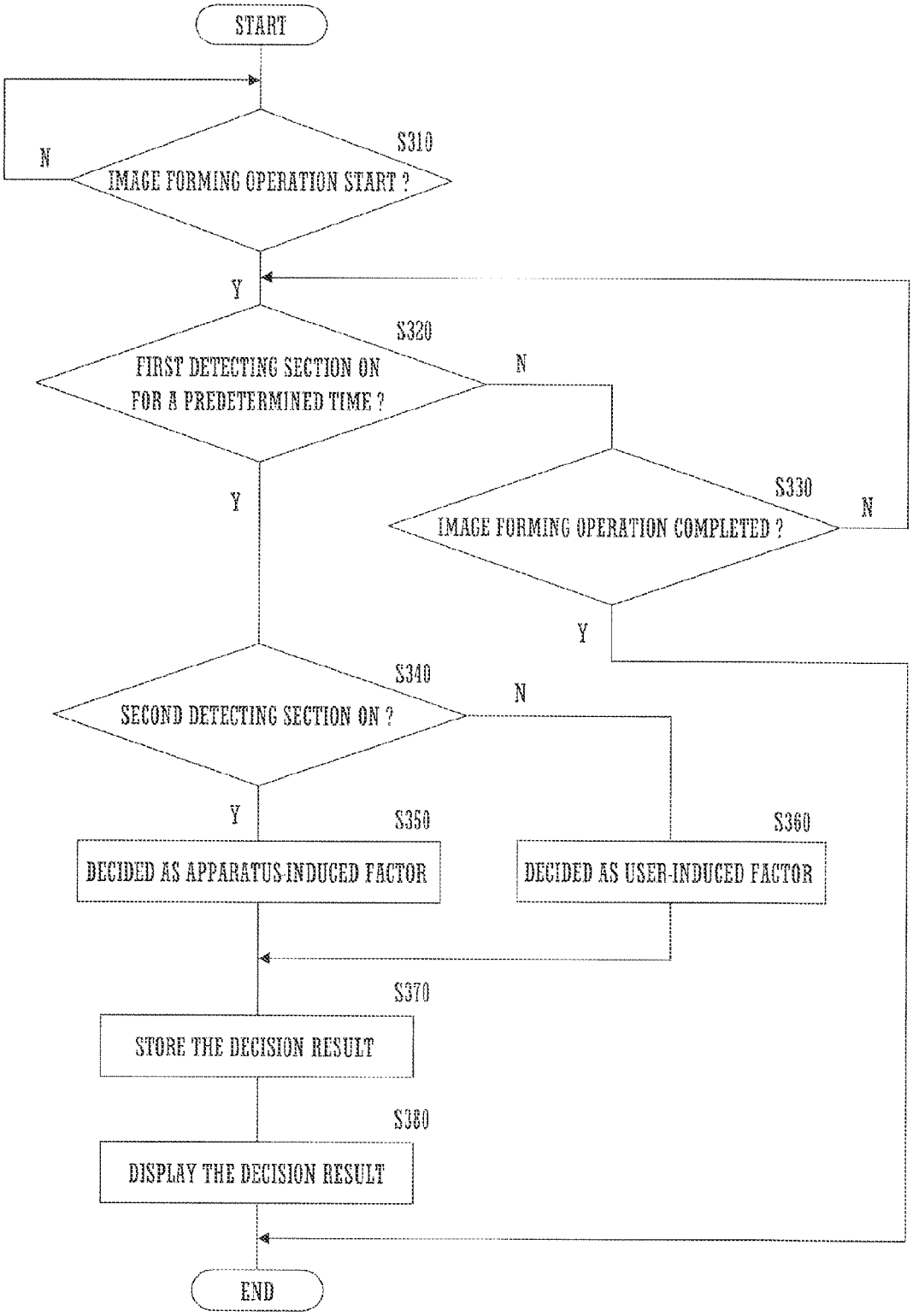
FIG. 11 is a flow chart showing control details of the image forming apparatus according to the fourth embodiment of the present invention.

FIG. 11 is a flow chart showing control details of the image forming apparatus according to the fourth embodiment of the present invention.

Figure 12:
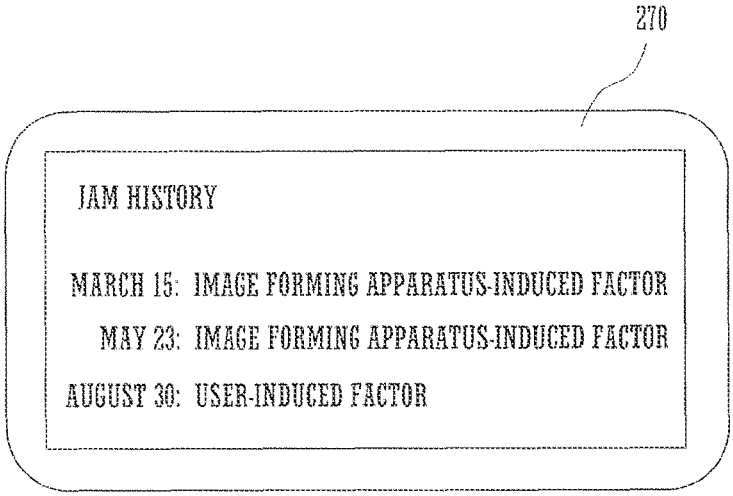
FIG. 12 is a diagram showing contents displayed on a second display section.

S310 through S370 show the same control details as S110 through S170. The CPU 300 causes the EEPROM 250 to store the decision result on the paper jam (S370), thereafter, as shown in FIG. 12, causes the display section 270 to display the occurrence factor (s) in the paper jam (s) as the history (S380), and then finishes the control according to this embodiment.

With this configuration, because it is made possible to display the occurrence factor (s) in the paper jam (s) as the history, the field service personnel, by referring to the contents displayed, can shorten the time required for analyzing the occurrence factor(s) in the paper jam(s). Further, enabled to determine a course of action to take for the maintenance task based on the analysis result, the field service personnel can perform the maintenance task on the image forming apparatus 100 quickly.

Next, a fifth embodiment of the present invention is explained.

Figure 13:
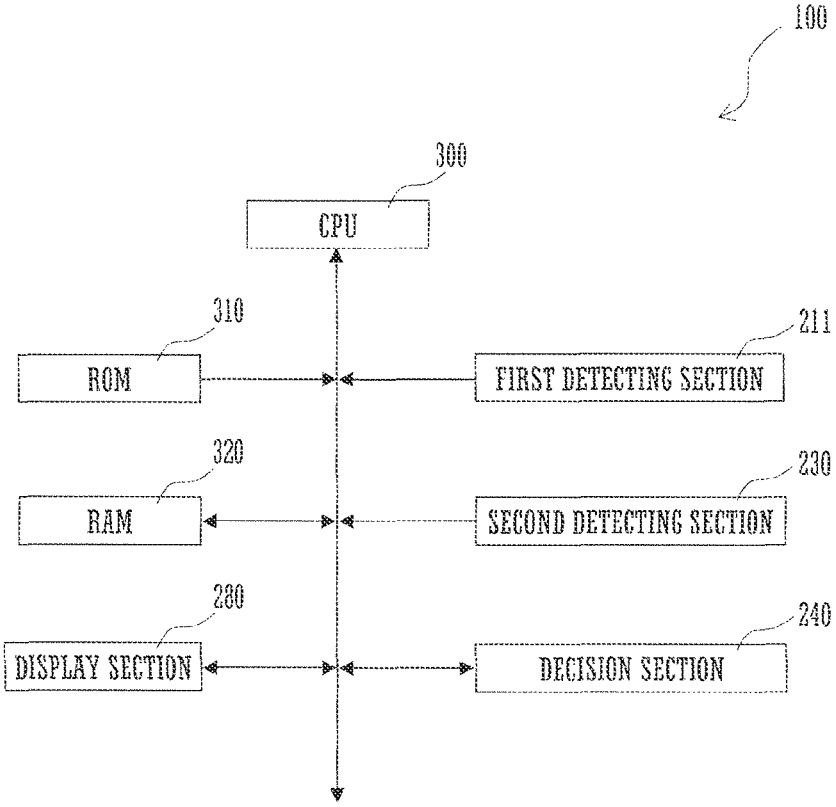
FIG. 13 is a block diagram showing an essential part of an image forming apparatus according to a fifth embodiment of the present invention.

FIG. 13 is a block diagram showing an essential part of an image forming apparatus according to the fifth embodiment of the present invention.

The image forming apparatus 100 according to the fifth embodiment further includes a display section 280 in relation to the image forming apparatus 100 according to the first embodiment. The display section 280 corresponds to a third display section of the present invention. When the decision section 240 judges the occurrence factor in the paper jam to be the user-induced factor, the display section 280 displays a message to the effect that a paper sheet on the lever 220, if any, should be removed.

Figure 14:
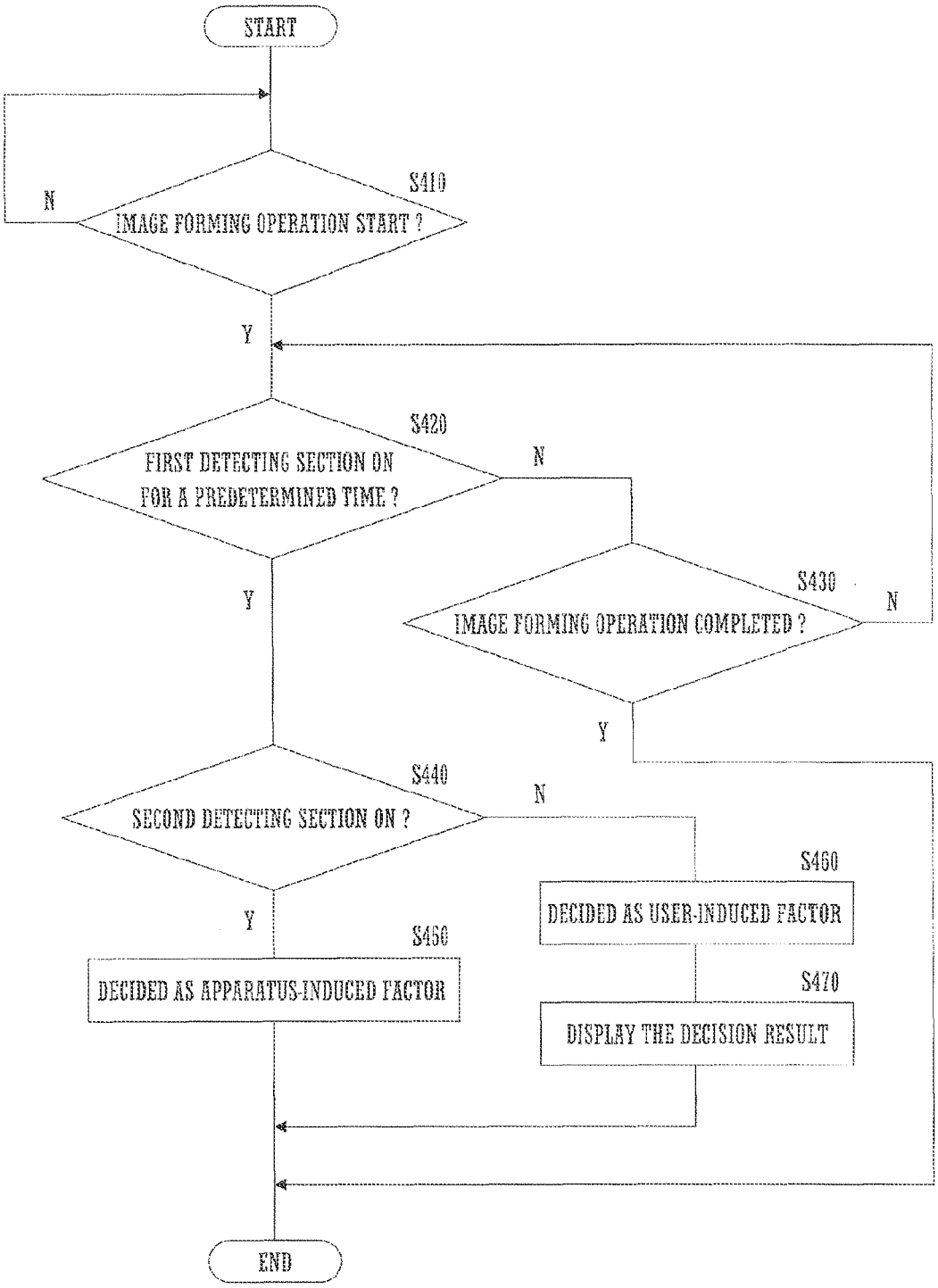
FIG. 14 is a flow chart showing control details of the image forming apparatus according to the fifth embodiment of the present invention.

FIG. 14 is a flow chart showing control details of the image forming apparatus according to the fifth embodiment of the present invention.

Figure 15:
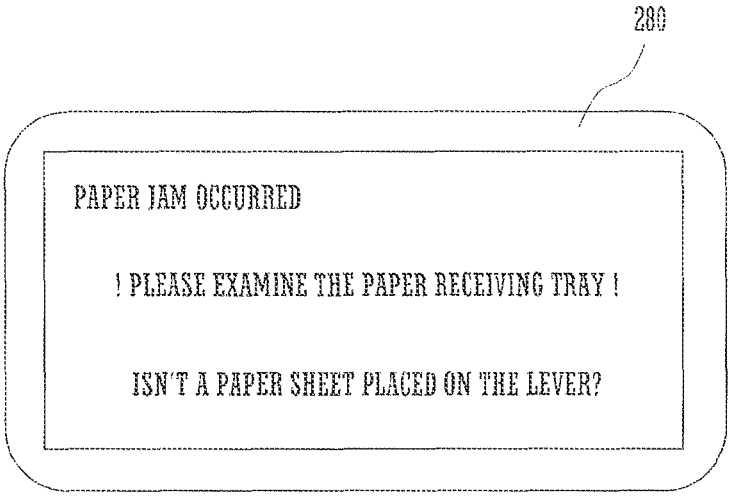
FIG. 15 is a diagram showing contents displayed on a third display section.

S410 through S460 show the same control details as S10 through S60. When the decision section 240 judges the occurrence factor in the paper jam to be the user-induced factor (S460), the CPU 300, as shown in FIG. 15, causes the display section 280 to display the message to the effect that a paper sheet on the second lever 220, if any, should be removed (S470), and finishes the control according to this embodiment.

With this configuration, because the display section 280 is caused to display the message to the effect that a paper sheet on the second lever 220, if any, should be removed when the decision section 240 judges the occurrence factor in the paper jam to be the user-induced factor, even a user who is inexperienced in jam handling can deal with the jam easily.

Subsequently, a sixth embodiment of the present invention is explained.

Figure 16:
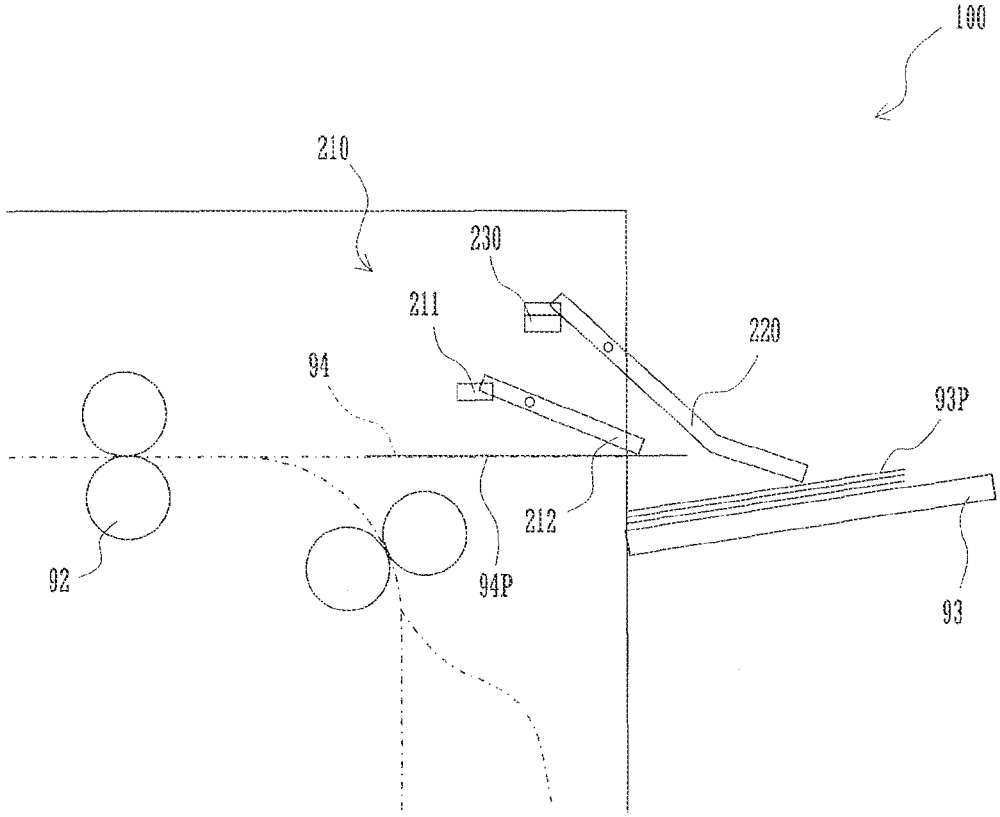
FIG. 16 is a diagram showing an essential part of an image forming apparatus according to a sixth embodiment of the present invention.

FIG. 16 is a diagram showing an essential part of an image forming apparatus according to the sixth embodiment of the present invention.

When a paper sheet 94P is conveyed to the discharge section 210, a first lever 212 is caused to swing by being pushed by the front edge of the paper sheet 94P, and thereby the first detecting section 211 is brought to the sensing state. Then, when the paper sheet 94P is discharged onto the paper receiving tray 93, the first lever 212 returns to its original position by its self-weight, and thereby the first detecting section 211 is brought to a non-sensing state.

That is to say, the first detecting section 211, by a change thereof from the sensing state to the non-sensing state, can detect an occurrence of the paper sheet 94P's having been discharged onto the paper receiving tray 93.

With this configuration, because the first detecting section 211 is a multifunctional detecting section capable of detecting the occurrence of the paper sheet 94P's having been discharged onto the paper receiving tray 93 as well as detecting the paper jam, parts count of the image forming apparatus 100 can be reduced.

Subsequently, a seventh embodiment of the present invention is explained.

Figure 17:
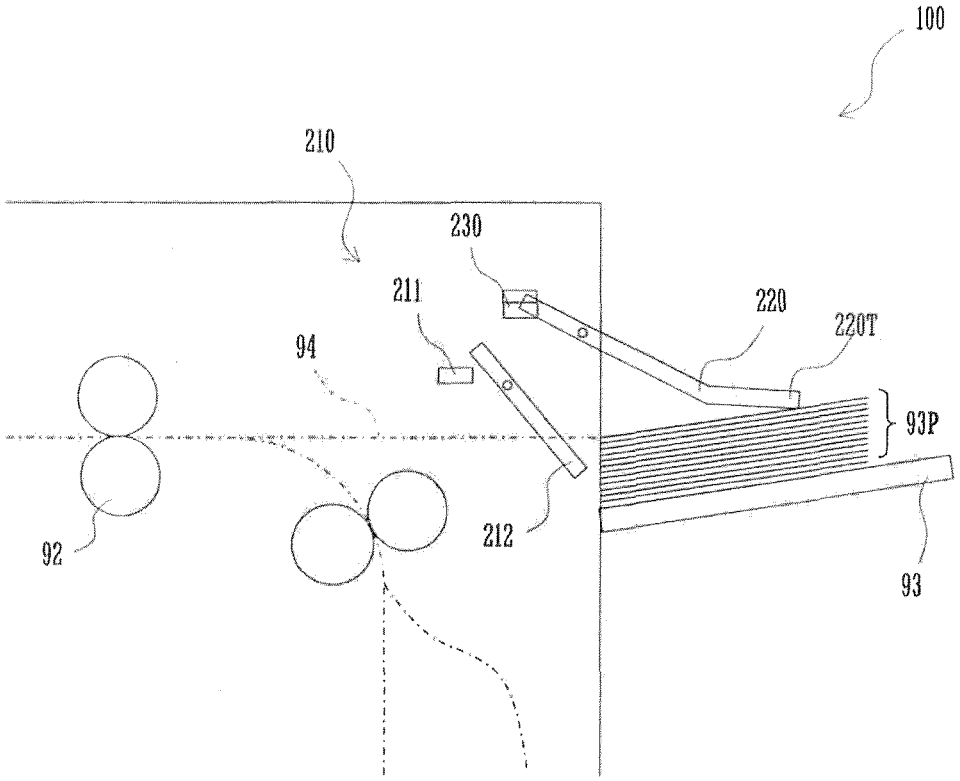
FIG. 17 is a diagram showing an essential part of an image forming apparatus according to a seventh embodiment of the present invention.

FIG. 17 is a diagram showing an essential part of an image forming apparatus according to the seventh embodiment of the present invention.

When an uppermost face of the paper sheets 93P that are piled up on the paper receiving tray 93 reaches a height of the paper sheet conveying path 94, no more paper sheet 93P can be discharged to the paper receiving tray 93. In other words, the paper sheets 93P on the paper receiving tray 93 are full. At this time, the second lever 220 is caused to swing to the second position by a tip portion 220T of the second lever 220 being in contact with the uppermost face of the paper sheets 93P, and thereby the second detecting section 230 is brought to a second position sensing state.

That is to say, the second detecting section 230, by detecting the state in which the lever 220 is swung to the second position, can detect a fullness of the paper sheets 93P on the paper receiving tray 93.

With this configuration, because the second detecting section 230 is a multifunctional detecting section capable of not only carrying out the detection on the occurrence factor in the paper jam in combination with the first detecting section 211 but also detecting the fullness of the paper sheets 93P on the paper receiving tray 93, parts count of the image forming apparatus 100 can be reduced.

Besides, each of the above-mentioned embodiments may be combined arbitrarily.

Finally, the above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

REFERENCE SIGNS LIST

93 paper receiving tray
100 image forming apparatus
210 discharge section
211 first detecting section
212 first lever
220 second lever
230 second detecting section
240 decision section
250 EEPROM
260 display section
270 display section
280 display section

The invention claimed is:

1. An image forming apparatus comprising:

an image forming section for forming an image onto a paper sheet;

a discharge section for discharging the paper sheet onto which the image forming section has formed the image;

a paper receiving tray for receiving thereon the paper sheet discharged from the discharge section;

a first detecting section for detecting a conveyance failure in the discharge section;

a lever that protrudes from a side of the discharge section toward the paper receiving tray and is caused to swing by being pushed by a front edge of a paper sheet in the process of being discharged from the discharge section;

a second detecting section that detects a swinging state of a tip portion of the lever from a first position to a second position, the tip portion being at the first position when the lever is not in the process of receiving an action of the paper sheet, the second position being farther from the paper receiving tray than the first position; and a decision section judging an occurrence factor in a conveyance failure to be a user-induced factor when the second detecting section detects a state in which the tip portion is at the first position when the first detecting section detects a conveyance failure, and judging the occurrence factor in the conveyance failure to be an image forming apparatus-induced factor when the second detecting section detects a state in which the tip portion is swung away from the first position when the first detecting section detects the conveyance failure.

2. The image forming apparatus as claimed in claim 1 wherein when the second detecting section detects a state in which the tip portion is swung to the second position, the decision section judges a state of the paper receiving tray as full with the paper sheets.

3. The image forming apparatus as claimed in claim 1 further comprising a memory section storing a result of a decision made by the decision section.

4. The image forming apparatus as claimed in claim 1 further comprising a first display section displaying a result of a decision made by the decision section.

5. The image forming apparatus as claimed in claim 3 further comprising a second display section displaying the occurrence factor in the conveyance failure stored by the memory section as a history.

6. The image forming apparatus as claimed in claim 1 further comprising a third display section, wherein when the decision section judges the occurrence factor in the conveyance failure to be the user-induced factor, the third display section displays a message that prompts a user to check whether there is a paper sheet on the lever.

7. The image forming apparatus as claimed in claim 1 wherein the first detecting section is configured to detect an occurrence of the paper sheet having been discharged onto the paper receiving tray.

* * * * *